United States Patent [19]

Amundsen

[11] Patent Number: 4,991,334

[45] Date of Patent: Feb. 12, 1991

[54] FILM STRIP HOLDER

[75] Inventor: Hanque F. D. Amundsen, Milwaukee, Wis.

[73] Assignee: Poblocki & Sons, Inc., Milwaukee, Wis.

[21] Appl. No.: 428,977

[22] Filed: Oct. 30, 1989

[51] Int. Cl.[5] ..... G09F 13/04

[52] U.S. Cl. ..... 40/568; 40/575

[58] Field of Search ..... 40/568, 585, 575, 576, 40/489, 490, 361, 5, 618

[56] References Cited

U.S. PATENT DOCUMENTS

| | | | |
|---|---|---|---|
| 2,280,096 | 4/1942 | Morrison | 40/618 X |
| 2,515,664 | 7/1950 | Padgett | 40/576 |
| 3,166,042 | 1/1965 | Hill | 40/490 X |
| 3,387,397 | 6/1968 | Buchanan et al. | 40/618 |
| 3,742,633 | 7/1973 | Palm | 40/618 X |
| 4,553,345 | 11/1985 | Bercier et al. | 40/618 X |
| 4,693,026 | 9/1987 | Callahan et al. | 40/618 X |

*Primary Examiner*—Kenneth J. Dorner
*Assistant Examiner*—J. Bonifanti
*Attorney, Agent, or Firm*—Joseph S. Heino

[57] ABSTRACT

A film strip holder for use in backlighted message displays is an extrusion having longitudinally extending, light opaque upper and lower portions and a longitudinally extending light translucent center portion such that a film strip placed between the upper and lower portions is in light transmissive relation to a light source within the display, the holder being engagable in substantially light-tight tongue and groove relationship with adjacent holders.

9 Claims, 2 Drawing Sheets

FILM STRIP HOLDER

FIELD OF THE INVENTION

The present invention relates to backlighted message directories used to display information in office buildings, shopping malls and the like and more particularly to negative film strip holders used within such directories.

BACKGROUND OF THE INVENTION

The use of negative film strips in backlighted message directories is well known. Such strips are formed by conventional photographic techniques and typically bear a name or other item of information which appears as transparent lettering on a substantially opaque background. It is also well known to use an array of film strip holders for placement of the film strips therein. These holder arrays, in turn, are backlighted to allow light to pass through the holders and through the transparent portions of the film strips being held.

In the past, it has been the practice to provide a message directory having a fixed vertical array of film strip holders, or segments of fixed vertical arrays, for holding a number of strips in place. While the film strips are able to be inserted into the holders interchangeably, the film strip holders themselves are fixed and unable to be interchanged with other holders in the array. Those types of message directories have several disadvantages. For example, when a single film strip is required to be added to or withdrawn from the array, it is necessary to disassemble the entire array of strips by removing each individual film strip and placing the strip in its new position in another adjacent holder. Another disadvantage with such an array is the fact that the film strips must be handled again subsequent to initial placement of them in the holders. Because of their thin composition, the films are subject to becoming misplaced, wrinkled or broken when handled. An example of such holders may be seen in U.S. Pat. No. 4,653,209 to Cobb.

Another type of directory currently available uses individual and interchangeable strip holders. These holders are typically comprised of two piece injection molded plastic parts that snap together. Each individual piece is molded to a precise size and must be matched with a mating piece. These types of message directories also have several disadvantages which are similarly difficult to overcome. For example, the injection molded parts are relatively expensive to tool. Also because each holder must have a relatively large opening disposed in it to permit light to pass through a substantial portion of the film strip held by it, these film holders tend to suffer from a lack of strength sufficient to protect the films or to prevent the holders themselves from unsnapping or breaking. For an example of such holders see U.S. Pat. No. 4,021,951 to Vanostrand.

SUMMARY OF THE INVENTION

It is, therefore, a principal object of this invention to provide for use in a backlighted message directory a new, useful and uncomplicated negative film strip holder which is economically fabricated and which provides for a minimal number of elements while providing strength and durability to the film strip holders and protection to the film strips being held. It is a further object to provide film strip holders which are flexible so as to be easily and efficiently assembled in the field and which are completely interchangeable with each other. It is yet another object to provide film strip holders which accomplish all of this while creating an aesthetically appealing and readily visible directory display.

The present invention has obtained these objects by use of an extruded negative film strip holder having longitudinally extending and co-extruded upper, middle and lower portions. The upper and lower portions are opaque and the middle portion is translucent These opaque and translucent portions or areas are developed or produced in a single extrusion by the insertion of dyes into different areas or portions of the extruding die opening. That is, as the raw material enters and passes through the extruding die opening, dyes which produce the opaque portions along the upper and lower portions of the co-extrusion are injected. By this process, a single extrusion with opaque and translucent portions or areas is produced. The strip holder upper and lower portions further include internal grooves extending the length of the holder for receiving at least one film strip between them. The grooves are so situated that when a film strip is retained by them, the strip is placed in light transmitting relationship to the translucent middle portion of the strip holder. The strip holder upper portion further includes a tongue extending along the length of the outer top surface of the upper portion. A groove extends along the length of the outer bottom surface of the lower strip holder portion. The tongue and groove are configured such that adjacent strip holders may be engaged in a vertical array and in a substantially light-tight configuration.

To remove or replace a film strip, the vertical array of strip holders is shifted upwardly at the point in the array where the change is desired to be made. The strip holder to be removed is then lifted such that it is disengaged from the tongue and groove arrangement with the strip holder situated immediately below it. The central portion of the strip holder is pulled outwardly and away from the display to a point where the ends of the strip holder become disengaged from the display frame holding the ends of the strip in the array. The film strip held can then be replaced or left out as desired. The reverse of this procedure is followed to insert a new strip. The foregoing and other features of the present invention will be further apparent from the description that follows.

DETAILED DESCRIPTION

Figure 1:
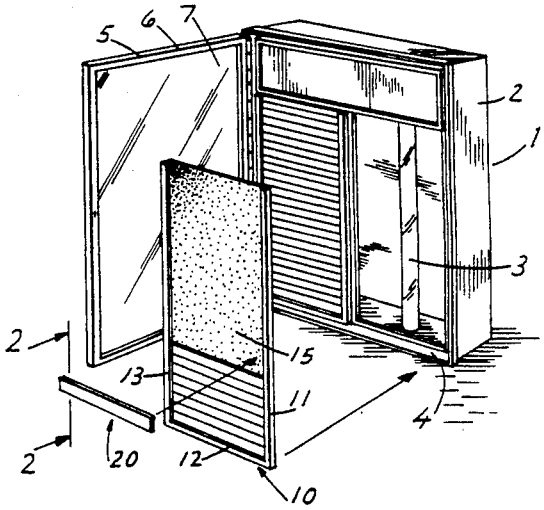
FIG. 1 is a partially exploded perspective view of a backlighted directory display cabinet showing a front access door open and a display frame embodying film strip holders of the present invention.
Figure 4:
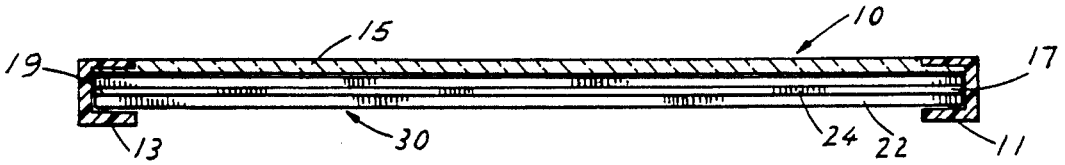
FIG. 4 is a plan view of the display frame shown in FIG. 1.

Reference is now made more particularly to the drawings and particularly to FIG. 1 which shows a number of film strip holders of the present invention incorporated into a backlighted message directory cabinet. As shown, the directory cabinet generally identified 1 comprises an outer frame 2 circumscribing a display frame holder 4 behind which is located a fluorescent light source 3. Attached to the cabinet outer frame 2 is a door 5 which comprises a door frame 6 and a plate of dark glass 7. The dark glass 7 is provided for enhanced visual effect of the display which will become more apparent further in this description. A display frame generally identified 10 is provided to be placed into and retained by the display frame holder 4. While the directory shown utilizes side-by-side display frames, it is to be understood that the size of the cabinet and/or the display frame is determined by the desired number of names or items of information to be displayed and is not a limitation imposed by the present invention. The message directory display frame 10 comprises first and second side members 11, 13, a bottom member 12 and a diffuser panel 15. The diffuser panel 15 may be constructed of any number of conventional materials which will cause diffusion of the light generated by the fluorescent light source 3 to provide a uniform illumination field behind the display frame 10. The display frame side members 11, 13 are provided with grooves 17, 19 for retaining the ends of a flexible film strip holder 20 of the present invention. See also FIGS. 4 and 5.

Figure 2:
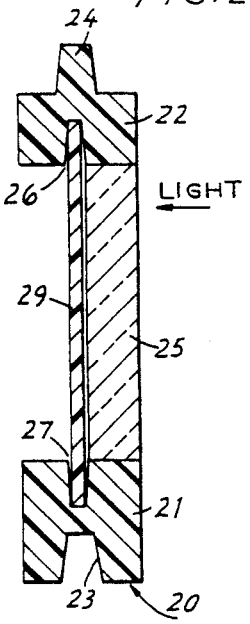
FIG. 2 is a vertical sectional view through a film strip holder of the present invention taken along line 2—2 of FIG. 1.

Reference is now made to FIG. 2, which is an enlarged vertical sectional view through the film strip holder 20 of FIG. 1 taken along line 2—2. The film strip holder 20 is a co-extrusion which comprises a bottom poriton 21, a top poriton 22 and a center poriton 25. The strip holder bottom and top portions 21, 22 and the center portion 25 are extruded as a single piece with the bottom and top portions 21, 22 being comprised of generally light opaque material and the center portion 25 being comprised of generally light translucent material. These opaque and translucent portions or areas are developed or produced in a single extrusion by the insertion of dyes into the extruding die opening. That is, dyes which produce the opaque portions along the upper and lower portions of the co-extrusion are injected as the raw material passes through the extruding die opening. As the co-extrusion leaves the extruding die a single extrusion having both the opaque and translucent portions or areas is produced. In such construction, the center portion 25 serves as an additional light diffuser with much the same purpose and function as that of the diffuser panel 15. The bottom strip holder portion further includes a longitudinally extending outer groove 23. The top strip holder portion 22 further includes a longitudinally extending outer tongue member 24. The outer groove 23 and outer tongue member 24 compliment each other and are configured such that consecutively arranged strip holders may be placed in a vertical array in a substantially light-tight tongue and groove configuration. The bottom strip holder portion 21 further includes an inner groove 27 and the top strip holder portion 22 includes an inner groove 26. The distance between the inner grooves 26, 27 is of a predetermined size and such that the strip holder slidably receives and retains a strip 29 which may or may not contain directory information on it. Each negative film strip has transparent and/or opaque portions depending upon the information to be displayed.

Figure 3:
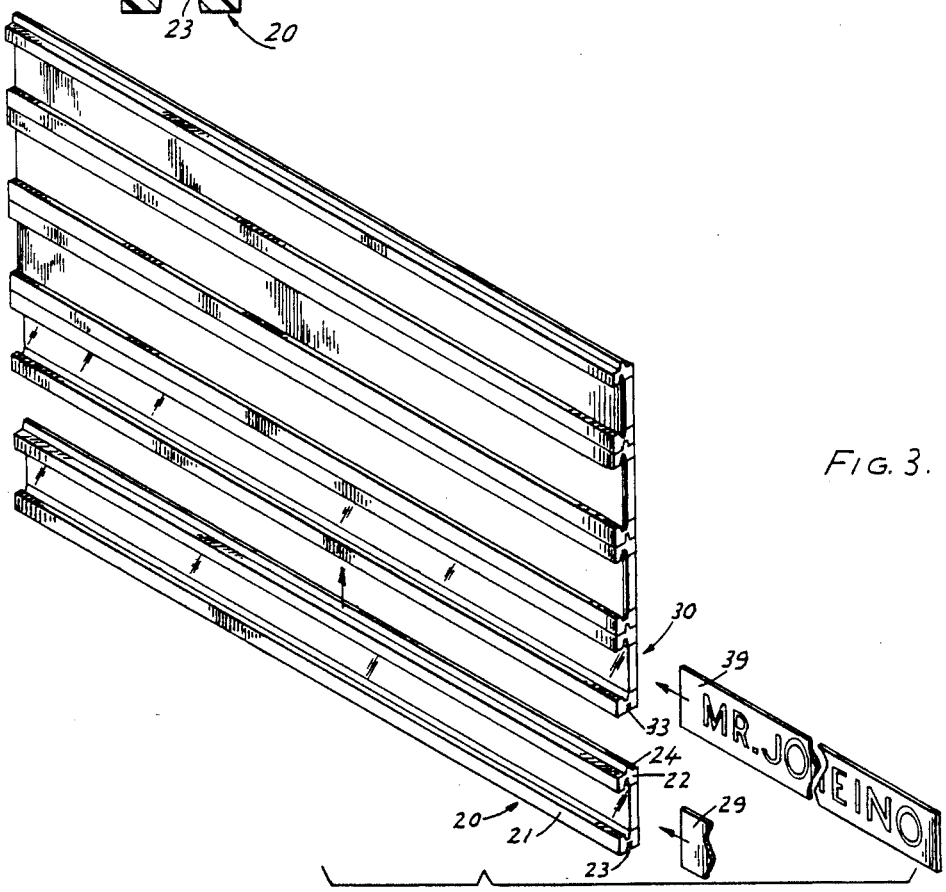
FIG. 3 is a detailed perspective view showing a vertical array of film strip holders of the present invention.

Referring part to FIG. 3, a vertical array of film strip holders is shown. As previously described, the bottom strip holder 20 includes a longitudinally extending tongue member 24 which engages the longitudinally extending outer groove 33 of the next uppermost strip holder 30. This relationship is true for each of the other strip holders shown. As each holder is placed one atop the other, the tongue member of one holder mates with the groove of the adjacent holder. This tongue and groove configuration prevents light from passing between adjacent holders. Slidably inserted into and retained by the strip holders 20, 30 are negative film strips 29, 39, respectively.

Figure 5:
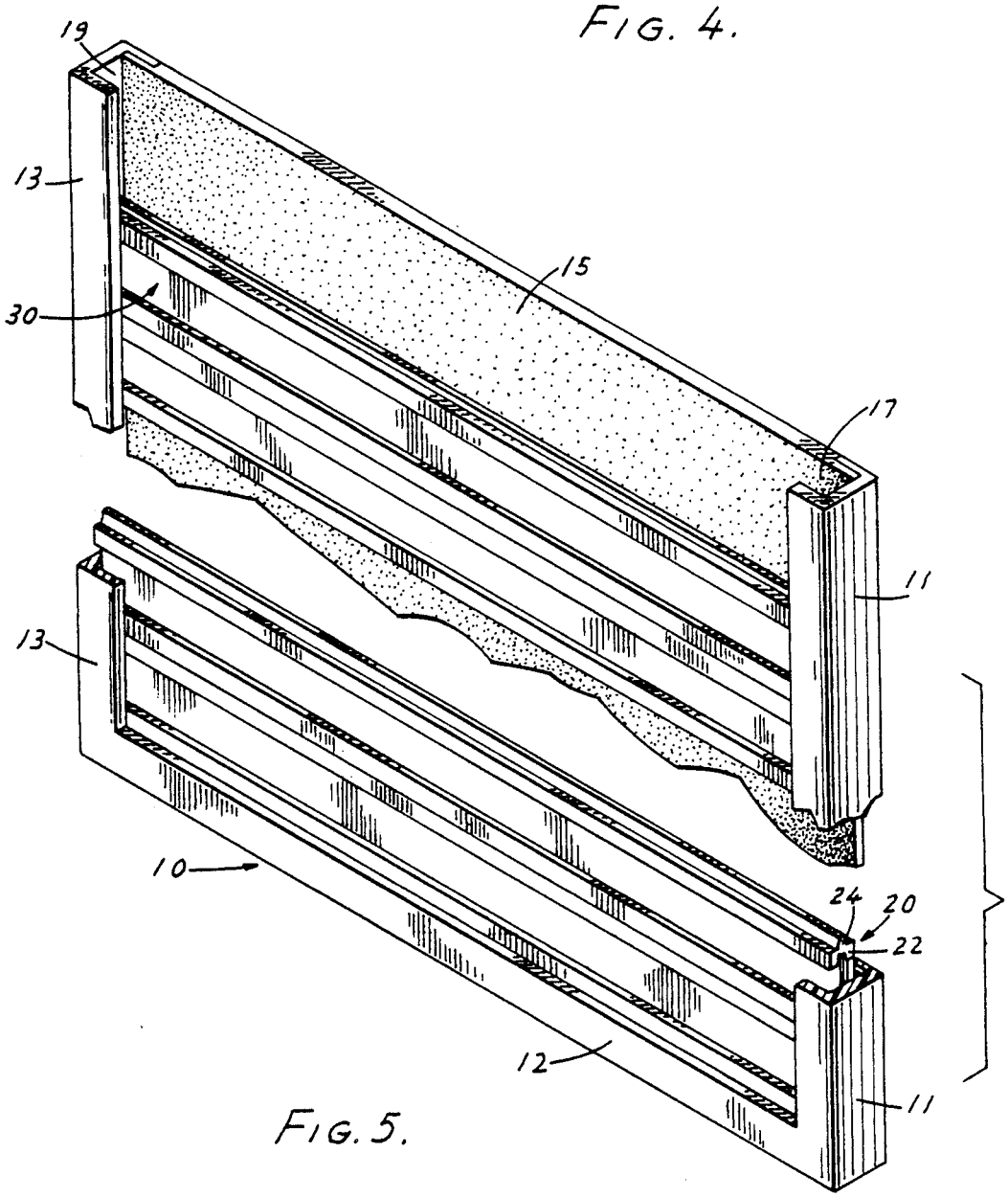
FIG. 5 is a fragmentary detailed perspective view of the display frame and film strip holders shown in FIG. 1.

Referring now to FIG. 5, the relationship between an array of adjacent film strip holders as the holders are held by the display frame 10 is shown in more detail. As shown, each end of the strip holder 20 is retained by the side grooves 17, 19 of the display frame side members 11, 13. In such configuration, the strip holders are placed in front of the diffuser panel 15 of the display frame 10. This holder array, in turn, is backlighted to allow light to pass through the holders and through the transparent portions of the film strips being held. See FIG. 1.

During initial installation of and array of strip holders of the present invention, the display frame 10 is removed from the display cabinet 1. See FIG. 1. Film strips, which may or may not contain directory information on them, are inserted into each of the strip holders in the array. See FIG. 3. With the strips and strip holders so assembled, the desired array is then determined and, one by one, the strip holders are inserted into the display frame 10 from the top by inserting the longitudinal ends of the strip holders into the respective retaining grooves 17, 19 of the display frame 10 and sliding them downwardly toward the bottom of it. The bottommost holder is retained by the bottom display frame member 12. See FIG. 5. The display frame 10 is then placed within the display frame holder 4 of the directory cabinet 1. With the fluorescent light source 3 placed behind the display frame diffuser 15 the only light transmitted through the display is that which is transmitted through the translucent portions of the strips inserted in the strip holders. The tongue and groove configuration of the strip holders prevents light from the fluorescent source 3 from passing between adjacent film strip holders. The effect of this is to form a continuous opaque background for the information displayed. The effect is enhanced when the cabinet door 5 is closed. The black glass 7 of the door causes the display to stand out as a single black monolithic element with illuminated information on it.

To insert a single film strip holder 20 into an already existing array of holders, the location of the strip and strip holder is first determined in the array. The array is then separated at a point where insertion is desired. The uppermost strip holders are pushed upwardly and the strip holder desired to be inserted is flexed sufficiently to allow the ends of the strip holder to slip under and become engaged by the display frame side members 11, 13. The strip holder is then unflexed and comes into alignment with the next lowermost strip holder. The uppermost strip holders are then lowered into tongue and groove relationship with the inserted strip holder. The same procedure can be followed for removing or substituting a flexible strip holder in a film strip holder array.

From the foregoing detailed description of the illustrative embodiment of the invention set forth herein, it will be apparent that there has been provided a new, useful and uncomplicated negative film strip holder for use in a backlighted message directory which is economically fabricated. Further it provides for a minimal number of elements while providing strength and durability to the film strip holders and protection to the film strips being held. It is flexible, is easily and efficiently assembled in the field, is completely interchangeable and accomplishes all of this while creating an aesthetically appealing directory display.

The principles of this invention having been fully explained in connection with the foregoing, I hereby claim as my invention:

1. A negative film strip holder for use in a message directory with backlighting which comprises a substantially flat and longitudinally extending holder member having a front poriton facing outwardly from said directory and a rear poriton facing inwardly toward said directory backlighting, said holder member comprises an extrusion having longitudinally extending upper, lower and middle portions, said upper and lower portions being comprised of opaque material and having a top and a bottom surface, respectively, and said middle portion being of translucent material, means for retaining a negative film strip within the outwardly facing front portion of said holder member in light transmissive relation to said directory backlighting, said strip retaining means including a complimentary and longitudinally extending internal groove situated within each of said outwardly facing front holder member upper and lower portions, said grooves being functionally adapted to accept a negative film strip therebetween and to hold said strip in light transmissive relation to said translucent holder middle poriton, and means for engaging said strip holder member with other adjacent holder members to form an array thereof.

2. The negative film strip holder of claim 1 wherein said strip holder engagement means comprises an upwardly and longitudinally extending external tongue member at the top surface of said holder member upper portion and a longitudinally extending groove at the bottom surface of said holder member lower portion, said tongue member and said groove being functionally adapted to engage in light restrictive relation to said directory backlighting.

3. The film strip holder of claim 1 wherein said extrusion is made of acrylic material.

4. A holder for retaining a negative film strip in light transmissive relation within a backlighted message directory display which comprises a longitudinally extending holder extrusion, said extrusion comprising an upper opaque portion, a middle translucent portion and a lower opaque portion, said upper and lower portions having complimentary internal grooves for retaining a negative film strip therebetween, and means for engaging said holder member with upwardly and downwardly adjacent holder members.

5. The holder of claim 4 wherein said holder member includes an upper portion top surface and a lower portion bottom surface, said upper portion top surface including a longitudinally extending tongue member and said lower portion bottom surface including a longitudinally extending groove which is complementary to said upper portion tongue member such that a light restrictive engagement is effected between adjacent holders.

6. The film strip holder of claim 4 wherein said extrusion is made of acrylic material.

7. A negative film strip holder for use in a backlighted message directory which comprises a longitudinally extending upper holder portion, said upper holder portion having a top surface and being comprised of opaque material, a longitudinally extending lower holder member portion, said lower holder portion having a bottom surface and being comprised of opaque material, a longitudinally extending middle holder member portion, said middle holder portion being interposed between said upper and lower holder member portions and being comprised of translucent material, a longitudinally extending tongue member extending upwardly from said upper holder portion top surface, a longitudinally extending groove extending along the bottom surface of said bottom holder portion, said tongue member and groove arranged and configured such that adjacent holder members are engaged in an interlocking and substantially light restrictive configuration.

8. The strip holder of claim 7 wherein said upper, lower and middle holder portions and said groove and tongue members are a single extrusion.

9. The film strip holder of claim 8 wherein said extrusion is made of acrylic material.

* * * * *